US006550635B1

(12) United States Patent
King et al.

(10) Patent No.: US 6,550,635 B1
(45) Date of Patent: Apr. 22, 2003

(54) PORTABLE FOLDED WIPER SYSTEM

(75) Inventors: Timothy James King, Clwyd (GB); James Justin Beech, Chester (GB); Neville John Pryke, London (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 702 days.

(21) Appl. No.: 08/935,916

(22) Filed: Sep. 23, 1997

Related U.S. Application Data

(63) Continuation of application No. 08/431,919, filed on Apr. 28, 1995, now abandoned.

(51) Int. Cl.[7] ..... A47K 10/24

(52) U.S. Cl. ..... 221/49; 221/33; 221/46; 221/64; 221/185; 383/43; 383/66

(58) Field of Search ..... 221/33, 49, 64, 221/46, 185; 150/900; 222/541.2; 383/43, 66

(56) References Cited

U.S. PATENT DOCUMENTS

| | | | | |
|---|---|---|---|---|
| 271,177 A | | 1/1883 | White | 206/57 |
| 546,849 A | | 9/1895 | Hughes | 221/45 |
| 678,434 A | | 7/1901 | Loewenbach | 221/210 |
| 877,347 A | | 1/1908 | Lazar | 206/57 |
| 1,490,215 A | | 4/1924 | Kaufman | 206/44 |
| 1,588,733 A | | 6/1926 | Hoberg | 206/57 |
| 1,673,112 A | | 6/1928 | Gage, Jr. | 206/44 |
| 1,883,008 A | * | 10/1932 | Sherman | 221/46 |
| 2,142,883 A | | 1/1939 | Chaney et al. | 206/44 |
| 2,504,515 A | * | 4/1950 | Gantner et al. | 221/46 |
| 2,574,345 A | | 11/1951 | Montgomery | 150/52 |
| 2,667,906 A | * | 2/1954 | Stiller | 150/900 |
| 2,754,029 A | * | 7/1956 | Maxley, Jr. | 221/46 |
| 2,840,268 A | | 6/1958 | Casey et al. | 221/49 |
| 2,909,203 A | * | 10/1959 | Greaves | 150/900 |
| 2,965,224 A | | 12/1960 | Harwood | 206/57 |
| 3,223,281 A | | 12/1965 | Larkin | 221/46 |
| 3,233,777 A | | 2/1966 | Farha | 221/45 |

(List continued on next page.)

FOREIGN PATENT DOCUMENTS

| | | | |
|---|---|---|---|
| CA | 719570 | 10/1965 | |
| DE | 3 242 145 | 5/1984 | |
| EP | 0132250 A | 1/1985 | |
| EP | 0 277 388 | 8/1988 | A47K/10/42 |
| GB | 855946 | 12/1960 | |
| GB | 1280218 | 7/1972 | |
| GB | 2015476 | 9/1979 | |
| GB | 2158033 A | 11/1985 | |

*Primary Examiner*—William E. Terrell
(74) *Attorney, Agent, or Firm*—Karl V. Sidor

(57) ABSTRACT

A portable folded wiper dispensing system for dispensing flexible sheets from a stack of sheets. The system includes a refillable apparatus and a stack of sheets. The refillable apparatus is composed of: 1) a relatively flat, flexible base devoid of dispensing slots, the flexible base being adapted to resiliently fold along a fold axis; and 2) a flexible cover defining an opening aligned in parallel relation to the fold axis of the flexible base such that the flexible cover is attached to said flexible base and is adapted to contain a stack of sheets. The opening defines a dispensing slot through which flexible sheets may be individually dispensed while the flexible base remains unfolded. When the flexible base is folded back along the fold axis, the opening defines a refill gap through which a stack of flexible sheets may be inserted. The stack of sheets may be in the form of a pack of sheets within a plastic wrap provided with an aperture along a major face of the pack which conforms to the dispensing slot of the apparatus.

22 Claims, 7 Drawing Sheets

U.S. PATENT DOCUMENTS

| | | | | | |
|---|---|---|---|---|---|
| 3,258,114 | A | | 6/1966 | King | 206/44.12 |
| 3,285,406 | A | | 11/1966 | Winesett | 206/57 |
| 3,721,360 | A | * | 3/1973 | Collie | 222/541.2 |
| 3,826,407 | A | | 7/1974 | Keating | 221/63 |
| 4,185,754 | A | | 1/1980 | Julius | 221/63 |
| 4,252,236 | A | | 2/1981 | Roccaforte | 206/44.12 |
| D262,422 | S | | 12/1981 | Ortiz et al. | D6/98 |
| 4,411,374 | A | | 10/1983 | Hotchkiss | 221/63 |
| 4,586,630 | A | * | 5/1986 | Loder | 221/46 |
| 4,626,457 | A | * | 12/1986 | Willie | 150/900 |
| 4,739,809 | A | | 4/1988 | Adams | 150/112 |
| 5,042,091 | A | | 8/1991 | Tonkens | 2/94 |
| 5,127,545 | A | | 7/1992 | French | 221/102 |
| 5,299,712 | A | | 4/1994 | Carlson et al. | 221/45 |
| D351,062 | S | | 10/1994 | Shapland et al. | D3/233 |

* cited by examiner

PORTABLE FOLDED WIPER SYSTEM

This application is a continuation of application Ser. No. 08/431,919 entitled "Portable Folded Wiper System" and filed in the U.S. Patent and Trademark Office on Apr. 28, 1995, now abandoned. This entirety of this application is hereby incorporated by reference.

TECHNICAL FIELD

The present invention relates generally to devices for dispensing flexible sheets from stacks of sheets.

BACKGROUND

Refillable dispensers for dispensing flexible sheets from stacks of sheets are known. These dispensers may suffer from several drawbacks. For example, the dispensers may have separate openings for dispensing and reloading. Such arrangements can require complex flaps, latches, hinges or the like that may add to the cost, complexity and likelihood of failure of the dispenser. Another disadvantage is that many of these dispensers are not conveniently portable. That is, they fail to offer "hands-free" portability and must be hand-carried by the user. Some conventional dispensers have yet another disadvantage in that they offer little or no protection to the flexible sheets from splashes of liquid, dirt, grease or other contaminants.

Accordingly, there is a need for a refillable apparatus for dispensing flexible sheets from stacks of sheets in which the sheets are dispensed and refilled from the same opening. A need exists for such a refillable apparatus for dispensing and refilling flexible sheets from a single opening without complex flaps, latches, hinges or the like. There is also a need for a refillable apparatus for dispensing flexible sheets that is conveniently portable and which may be adapted to offer "hands-free" portability. A need also exists for a refillable apparatus for dispensing flexible sheets from a stack of sheets which protects the stack of sheets from splashes of liquid, dirt, grease or other contaminants. Furthermore, there is a need for a refillable apparatus for dispensing flexible sheets from a stack of sheets which is itself highly conformable, flexible and can be squeezed into limited spaces.

SUMMARY OF THE INVENTION

The present invention addresses the needs described above by providing a refillable apparatus for dispensing flexible sheets from a stack of sheets. The apparatus is composed of: 1) a relatively flat, flexible base devoid of dispensing slots, the flexible base being adapted to resiliently fold along a fold axis; and 2) a flexible cover (i.e., a flexible top) defining an opening aligned in parallel relation to the fold axis of the flexible base, said flexible cover (i.e., flexible top) being attached to said flexible base and adapted to contain a stack of sheets; such that the opening defines a dispensing slot through which flexible sheets may be individually dispensed while the flexible base remains unfolded, and the opening defines a refill gap through which a stack of flexible sheets may be inserted when the flexible base is folded back along the fold axis.

The stack of sheets may be in the form of a pack of sheets within a plastic wrap provided with an aperture along a major face of the pack which conforms to the dispensing slot of the apparatus.

The flexible base and/or the flexible cover may be composed of a variety of resilient materials including, but not limited to foamed polymeric materials. For example, the flexible base may be composed of foamed poly(ethylene-vinyl acetate). The foamed poly(ethylene-vinyl acetate) may have a density ranging from about 160 kg/m$^3$ to about 240 kg/m$^3$. For example, the foamed poly(ethylene-vinyl acetate) may have a density of about 200 kg/m$^3$.

According to an embodiment of the invention, the flexible base may be formed of any suitable resilient material (i.e., resiliently flexible material) such that it may require from about 2 to about 5 pounds force to fold it back along its fold axis so that the opening in the cover (i.e., flexible top) defines a refill gap through which a stack of flexible sheets may be inserted. For example, the flexible base may require from about 3 to about 4 pounds force to fold it back along its fold axis so that the opening in the cover defines a refill gap through which a stack of flexible sheets may be inserted. According to the invention, the fold axis of the flexible base may be a longitudinal fold axis.

The flexible cover (i.e., flexible top) may be composed of two discrete elements arranged to define an opening aligned in parallel relation to the fold axis of the flexible base. The flexible cover (i.e., flexible top) may also be composed of a single piece of material having an aperture which defines an opening aligned in parallel relation to the fold axis of the flexible base. It is contemplated that the flexible base and flexible cover (i.e., flexible top) may also be integral or composed of a single piece of material. In any case, the opening in the flexible cover may be fitted with a closure means. Exemplary closure means for the opening in the flexible cover include, but are not limited to, zippers, clasps, clamps, snap fasteners, hook and loop fasteners, straps, ties, and hooks.

According to the invention, the flexible base may include attachment means. That is, the flexible means may include means to removably attach the apparatus to a surface, bracket, holder, article of clothing or to a portion of the body of a person using the apparatus. Exemplary attachment means include, but are not limited to, belt slots, snap fasteners, hook and loop fasteners, clips, clasps, straps, ties, and hooks.

The present invention encompasses a refillable apparatus for dispensing flexible sheets from a stack of sheets, the apparatus being composed of: 1) a relatively flat, flexible base devoid of dispensing slots, the flexible base being formed of a foamed polymeric material and adapted to resiliently fold along a fold axis; and 2) a flexible cover defining an opening aligned in parallel relation to the fold axis of the flexible base, said flexible cover being formed of a single piece of foamed polymeric material which is attached to said flexible base and adapted to contain a stack of sheets; such that the opening defines a dispensing slot through which flexible sheets may be individually dispensed while the flexible base remains unfolded, and the opening defines a refill gap through which a stack of flexible sheets may be inserted when the flexible base is folded back along the fold axis.

The present invention further encompasses a refillable apparatus for dispensing flexible sheets from a stack of sheets, the apparatus being composed of: 1) a relatively flat, flexible base devoid of dispensing slots, the flexible base being formed of a foamed poly(ethylene-vinyl acetate) material having a density ranging from about 160 kg/m$^3$ to about 240 kg/m$^3$ and adapted to resiliently fold along a longitudinal fold axis; and 2) a flexible cover defining an opening aligned in parallel relation to the longitudinal fold axis of the flexible base, the flexible cover being formed of a single piece of foamed poly(ethylene-vinyl acetate) having a density ranging from about 160 kg/m$^3$ to about 240 kg/m$^3$ which is attached to said flexible base and adapted to contain a stack of sheets; such that the opening defines a dispensing slot through which flexible sheets may be individually dispensed while the flexible base remains unfolded, and the opening defines a refill gap through which a stack of flexible sheets may be inserted when the flexible base is folded back along the longitudinal fold axis.

Desirably the flexible base and flexible cover are composed of foamed poly(ethylene-vinyl acetate) having a density of about 200 kg/m$^3$ and which is resiliently flexible such that it may require from about 2 to about 5 pounds force to fold the flexible base back along its fold axis so that the opening in the cover defines a refill gap through which a stack of flexible sheets may be inserted.

DETAILED DESCRIPTION

Figure 1:
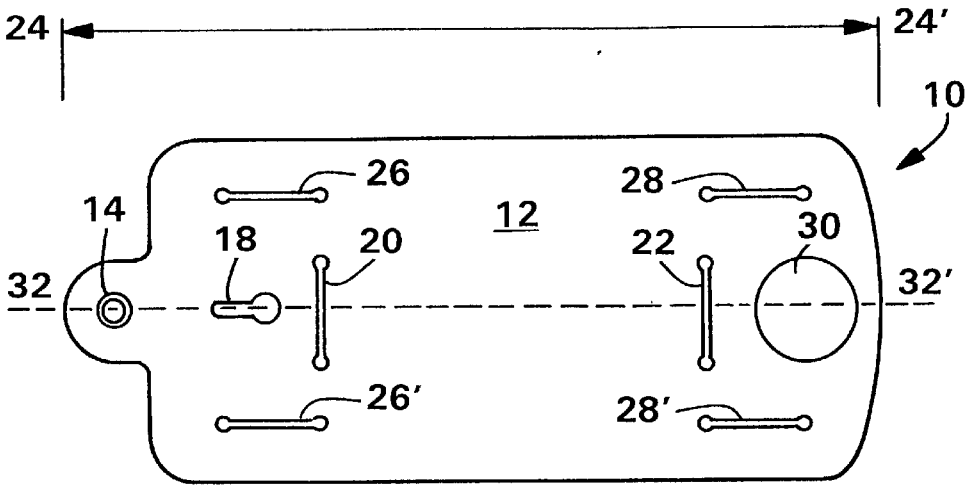
FIG. 1 illustrates a rear view of an exemplary refillable apparatus for dispensing flexible sheets from a stack of sheets.

The present invention is directed to a refillable apparatus for dispensing flexible sheets from a stack of sheets. FIG. 1 illustrates a rear view of an exemplary refillable apparatus 10 for dispensing flexible sheets from a stack of sheets. The rear view depicts a flexible base 12 which is part of the apparatus 10. As is clear from FIG. 1, the flexible base 12 may contain openings and/or attachment means but is devoid of dispensing slots. The flexible base 12 may contain or include a variety of attachments means. For example, a female portion of a snap fastener system 14 can be located on a small nub 16 projecting from the flexible base 12. That portion of a snap faster 14 may be designed to fasten to the corresponding male portion (not shown) which may be attached to a surface, mounted to an article or affixed to an article of clothing or the like.

A keyhole slot 18 can be located on the flexible base 12 and may be adapted to mount the flexible base 12 to screws, nails, pegs hooks or the like projecting from a surface, A first slot 20 and a second slot 22 located along the longest dimension 24–24' of the flexible base 12 are adapted to receive a belt, strap or the like. In a similar manner a first pair of slots 26 and 26' and a second pair of slots 28 and 28' (in perpendicular relation to the first slot 20 and second slot 22) are adapted to receive a belt, strap or the like. The pairs of slots may be used separately or in combination. As can be readily observed from the orientation of the first and second slots 20 and 22 and the pairs of slots 26, 26' and 28, 28', the apparatus 10 may be mounted horizontally or vertically.

A large opening 30 can be located on the flexible base 12 and may be adapted to receive a knob, hook or other projectile in order to mount the apparatus. Each of the attachment means described above may be used alone or in combination if present on the apparatus. It is contemplated that other attachment systems such as, for example, clasps, clips, hook and loop fasteners, semi-permanent adhesives or the like may be used.

According to the invention, the flexible base 12 is adapted to resiliently fold along a fold axis. A variety of fold axis configurations are contemplated. Desirably, the fold axis will run in relative proximity to a line 32–32' bisecting the center of the longest dimension 24–24' of the flexible base 12.

Figure 2:
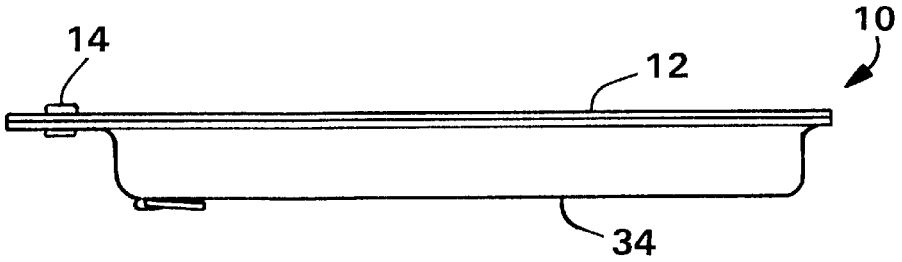
FIG. 2 illustrates a side view of an exemplary refillable apparatus for dispensing flexible sheets from a stack of sheets.

FIG. 2 is a side view of an exemplary apparatus 10. As can be readily seen, the flexible base 12 is joined to a flexible cover 34 (i.e., a flexible top). The flexible base 12 and flexible cover 34 may be joined by any suitable method. Glues, adhesives, solvent welding, ultrasonic welding, stitching, thermal bonding, staples or the like may be used. Of course, it is not necessary that the base and cover (i.e., top) be fabricated separately. It is contemplated that the apparatus may be formed as a single article in which the base and cover (i.e., top) are integral or formed from a single piece of material. This could be accomplished by injection molding or similar operations. The flexible base 12 and flexible cover 34 may be made utilizing conventional vacuum thermo-forming processes. A plug assist may be employed in such processes to help formation of the molded article. It is contemplated the designs may be embossed into the cover and/or base by patterns placed in the vacuum mold and/or on the plug assist.

Figure 3:
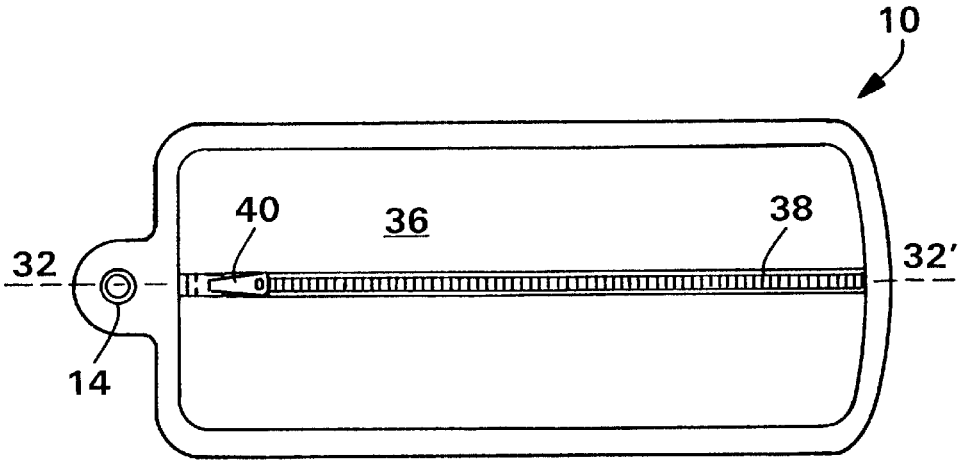
FIG. 3 illustrates a top view of an exemplary refillable apparatus for dispensing flexible sheets from a stack of sheets.

FIG. 3 is a top view of an exemplary apparatus 10 showing the flexible cover 34. The flexible cover 34 may be composed of two discrete elements (not shown). These elements may be arranged to define an opening aligned in parallel relation to the fold axis of the flexible base. The flexible cover may also be composed of a single piece of material as shown in FIG. 3. The single piece of material is configured to have an opening which defines a dispensing slot 38 aligned in parallel relation to the fold axis of the flexible base 12 (i.e., the line 32–32' bisecting the center of the longest dimension 24–24' of the flexible base 12). FIG. 3 depicts the apparatus 10 with a zipper 40 closing the dispensing slot 38.

Figure 4:
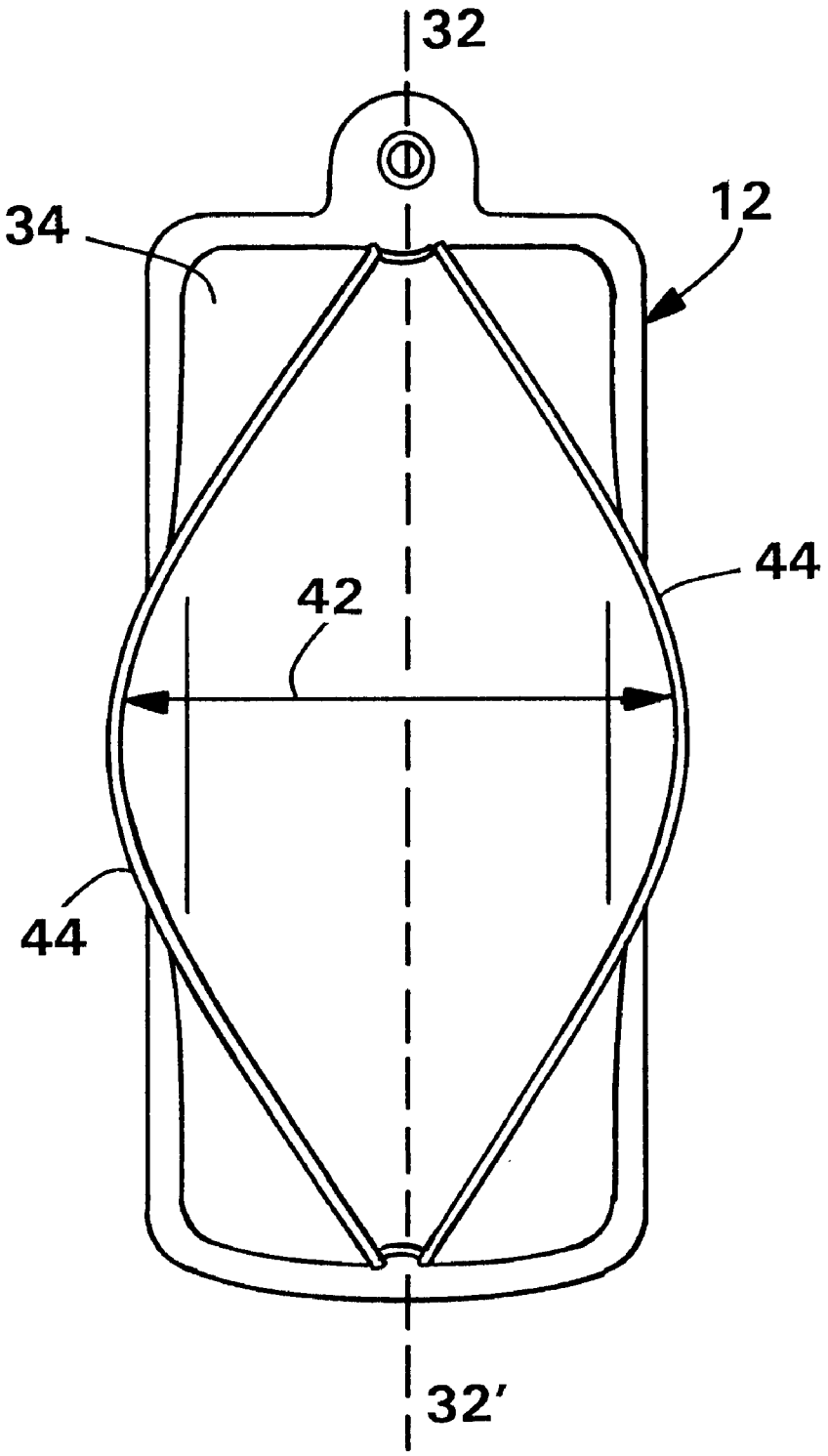
FIG. 4 illustrates a top view of an exemplary refillable apparatus for dispensing flexible sheets from a stack of sheets.

FIG. 4 illustrates a top view of an exemplary refillable apparatus 10 for dispensing flexible sheets from a stack of sheets while the flexible base is folded along its fold axis (i.e., the line 32–32' bisecting the center of the longest dimension 24–24' of the flexible base 12) causing the opening in the flexible cover 34 to convert from a dispensing slot 38 to a much larger refill gap 42. As can be seen from this view, folding the flexible base 12 back into a upside down U shape causes the edges 44 of the opening to be thrust wide open thereby creating a refill gap 42 large enough for a clip or stack of sheet material to be inserted into the apparatus 10. Generally speaking, the force needed to fold or bend back the flexible base 12 and open up the flexible cover 34 should be in the range of about 2 to about 5 pounds force (as measured utilizing an Accuforce® Cadet Force Gage available from Ametek Inc., Mansfield & Green Division). Desirably, the force may be in the range of about 3 to about 4 pounds force. While the force may vary depending upon the material used to make the flexible base 12 and/or the flexible cover 34, the material should require sufficient force for bending so that the apparatus 10 avoids popping open and dropping or otherwise losing sheet material.

Foamed poly(ethylene-vinyl acetate) is an example of a suitable material which may be used in to make the flexible base 12 and/or flexible cover 34. Relatively thin sheets of that foam material having a density between about 160 $kg/m^3$ to about 240 $kg/m^3$ require suitable levels of force as described above to open the apparatus 10. Moreover, once the flexible base 12 is folded, sheets of the poly(ethylene-vinyl acetate) exert a retractile force (a force from the material once all external opening force is removed) ranging from about 0.5 to about 1.5 pounds force (as measured utilizing an Accuforce® Cadet Force Gage available from Ametek Inc., Mansfield & Green Division) which urges the flexible base 12 back into a relatively flat configuration thereby causing the opening in the flexible cover 34 to close back into a dispensing slot 38.

Certainly, other materials may be used to form the flexible base and the flexible cover. A wide variety of foamed and un-foamed polymeric materials are contemplated. Desirably, these materials would have densities and opening and closing properties similar to those described above. It is also desirable that the material (e.g., foamed polymeric material) have some stretch and recovery properties. That is, it is thought that if the material is able to stretch slightly (e.g., stretch up to 5 or 10 percent or more) and substantially recover from that stretching, the flexible cover 34 could more readily be converted from a dispensing slot 38 to a refill gap 42 and back again.

Dispensers made of rigid or brittle materials occupy a defined space and cannot be squeezed or conformed to fit into a smaller space or a confined area having different dimensions. The flexible materials provide another advantage in that the dispenser constructed of such material is conformable and can be squeezed to fit into a toolbox or other confined area. Also, flexible materials are unlikely to fracture or break under an impact or if dropped.

Figure 5:
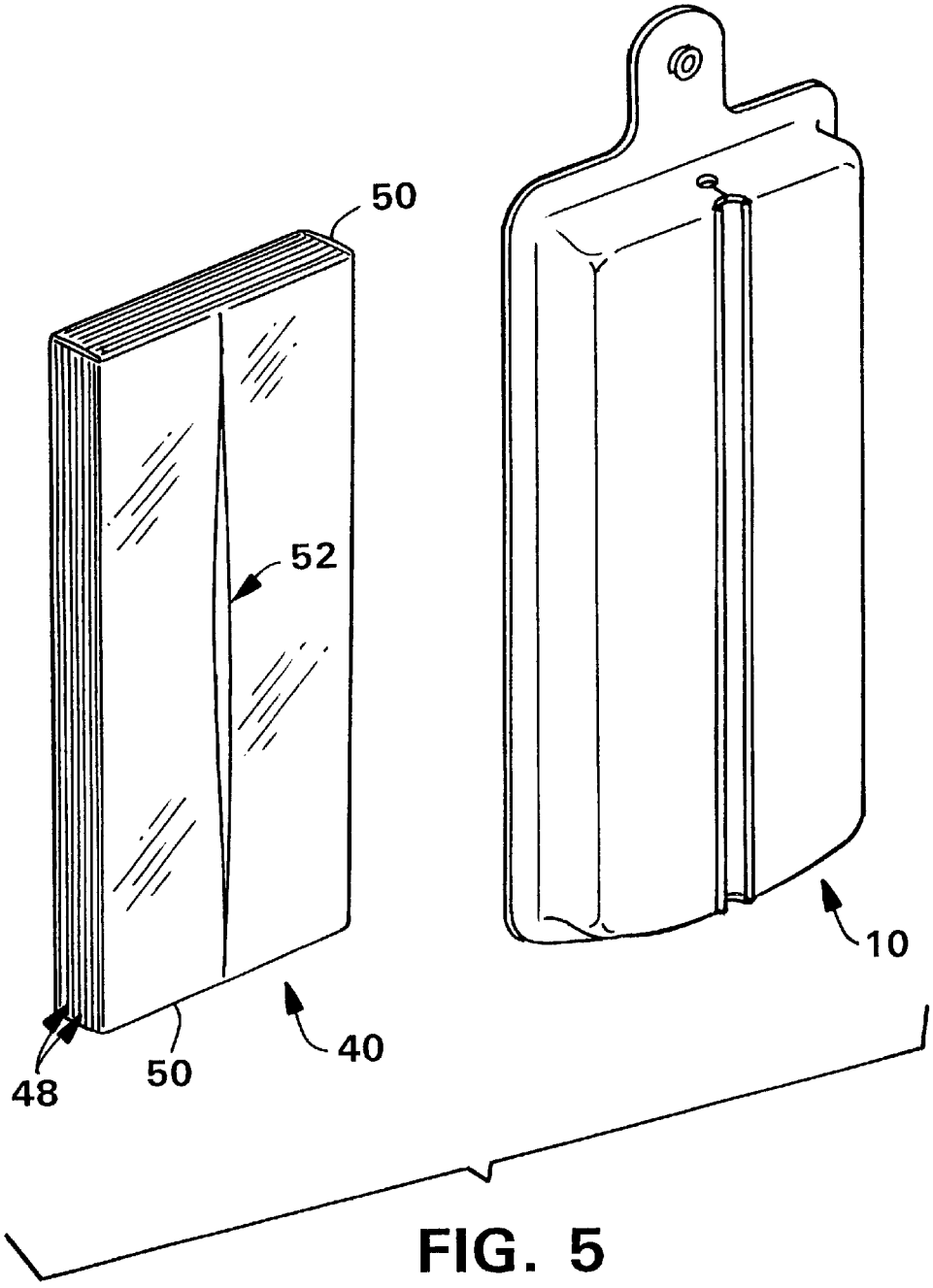
FIG. 5 illustrates a perspective view of an exemplary refillable apparatus for dispensing flexible sheets from a stack of sheets as well as an exemplary stack of flexible sheets with a plastic wrapper.

FIG. 5 illustrates a perspective view of an exemplary refillable apparatus 10 for dispensing flexible sheets from a stack of sheets as well as an exemplary stack 46 of flexible sheets 48 with a plastic wrapper 50. As can be seen from FIG. 5, the stack 46 of flexible sheets 48 is about the same size as (or slightly smaller than) the apparatus 10. For example, if the stack 46 is a stack of industrial wipes, it may be about 9.5 inches (~24 cm) along its longest dimension, about 4 inches (~11 cm) along its width dimension, and about 1.5 inches (~4 cm) in height. Accordingly, an apparatus for dispensing such a stack of wipers would have about the same or marginally larger dimensions.

The plastic wrapper 50 surrounding the stack 46 of flexible sheets 48 serves to protect the flexible sheets from contamination by incidental splashes of liquid, dust, grease or other materials. It is desirable that the stack 46 of flexible sheets 48 contain an aperture 52 in the plastic wrapper 50 to allow ready access to the flexible sheets 48. The aperture 52 may be of almost any length. For example, the aperture 52 may run the full length or almost the full length of the stack 46 of flexible sheets 48. Desirably, the aperture 52 will be about one-half the length of the stack 46 of flexible sheets 48 and will be located at the center of the stack so that the ends of the aperture 52 are separated from each end of the stack 46 by a distance which is approximately a quarter of the length of the stack.

When the stack 46 of flexible sheets is inserted into the apparatus 10, both the apparatus and the plastic wrapper help prevent undesired contamination. Accordingly, it is also desirable that the stack 46 contain flexible sheets 48 (e.g., wipers or the like) which are not interfolded. That is, it is desired in some embodiments of the invention that removal of one sheet should avoid extracting a portion of the next sheet outside the apparatus 10 as is common in many conventional dispenser of interfolded tissues. Keeping all the sheet material inside the dispenser by using non-interfolded stacks of sheets (e.g., Z-folded sheets, C-folded sheets or the like) is desirable because it helps to avoid contamination of the sheets by incidental splashes of liquid, dirt, grease or the like. Such an arrangement of non-interfolded stacks of sheets is practical in the apparatus 10 of the present invention because of the relative flexibility of the flexible cover 34 which permits easy access to the sheets. That is, the flexibility of the cover permits easy access into the dispensing slot and even allows relatively narrow dispensing slots to be employed while permitting practical dispensing. Narrow dispensing slots are desirable because they help prevent contamination of the wipes. Of course, the present invention contemplates the use of interfolded wiper in the apparatus and/or relatively wide dispensing slots.

Figure 6:
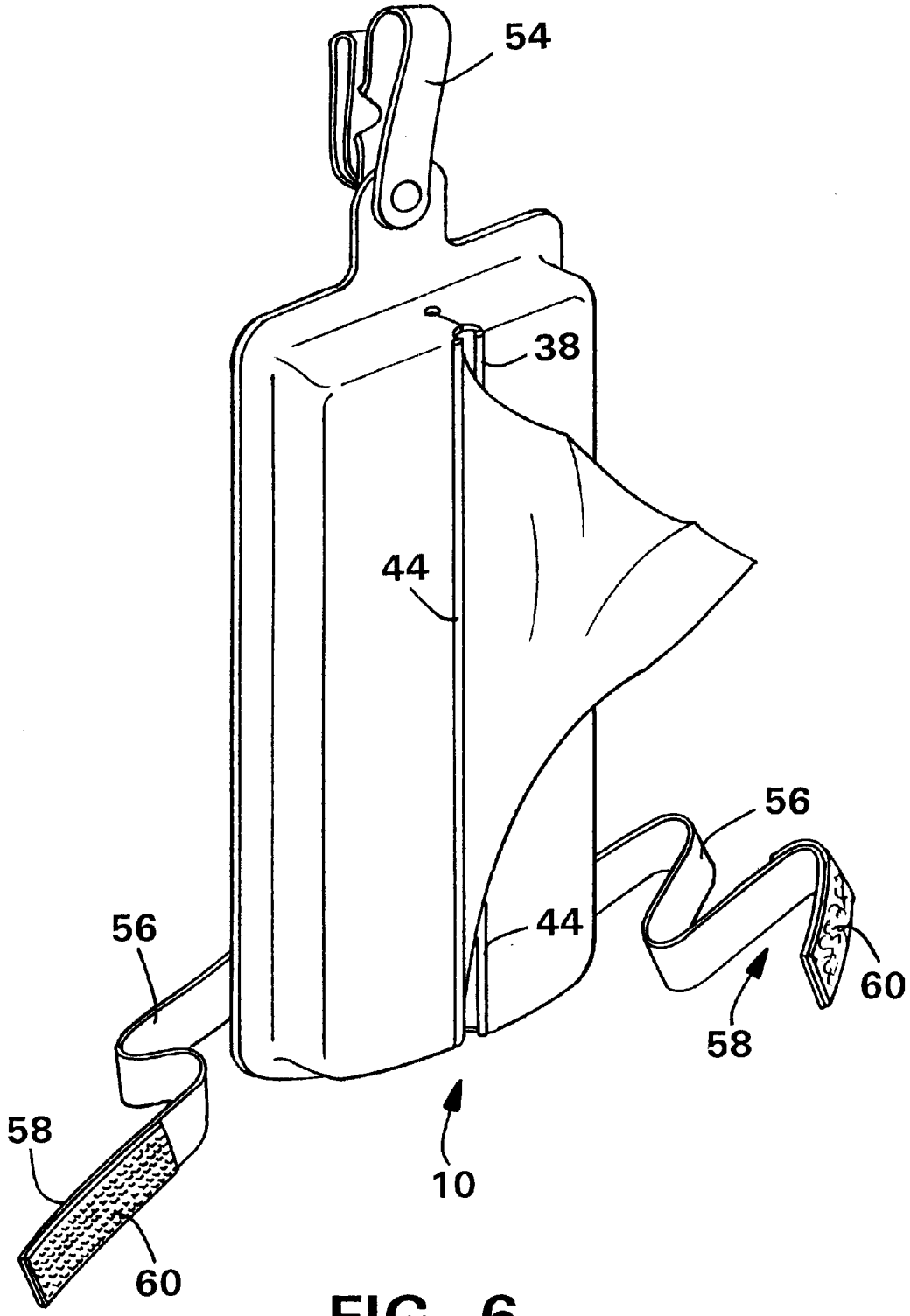
FIG. 6 illustrates a perspective view of an exemplary refillable apparatus for dispensing flexible sheets from a stack of sheets.

FIG. 6 illustrates a top perspective view of an exemplary refillable apparatus 10. As can be seen from the illustration, the apparatus 10 has attachment means in the form of a clip 54 and in the form of a band 56 (e.g., a strap). The ends 58 of the band 56 may be joined by any suitable method such as, for example, buckles, clips, snaps, hook and loop fasteners or the like. Desirably, the ends 58 of the band 56 are fitted with snaps or snap fasteners (e.g., poppers).

The clip 54 may be used to attach the apparatus 10 to an article of clothing such as the top of trousers, to a belt, to a belt loop or the like. The band 56 (e.g, strap) may be used to hold the end the apparatus 10 opposite the clip 54 against a portion of the body. For example, the clip 54 may be used to hold the top of the apparatus 10 near the waist and the band 56 may be used to hold the other end against a limb (e.g., a leg).

The band 56 may be used with or without the clip 54. For example, the band and any suitable attachment means fitted at the ends of the band could be looped around a toolbox handle, trolley handle or the like.

FIG. 6 also depicts the edges 44 of the cover 34 defining a dispensing slot 38. A single sheet of flexible material is shown protruding through the dispensing slot 38. In this example, no closure means are connected to the edges 44 of the cover 34. Generally speaking, if an appropriate material is selected for the flexible cover 34, the flexible cover 34 can have adequate levels of flexibility and retractile force which would alleviate the need for closure means on the dispensing slot 38.

Figure 7:
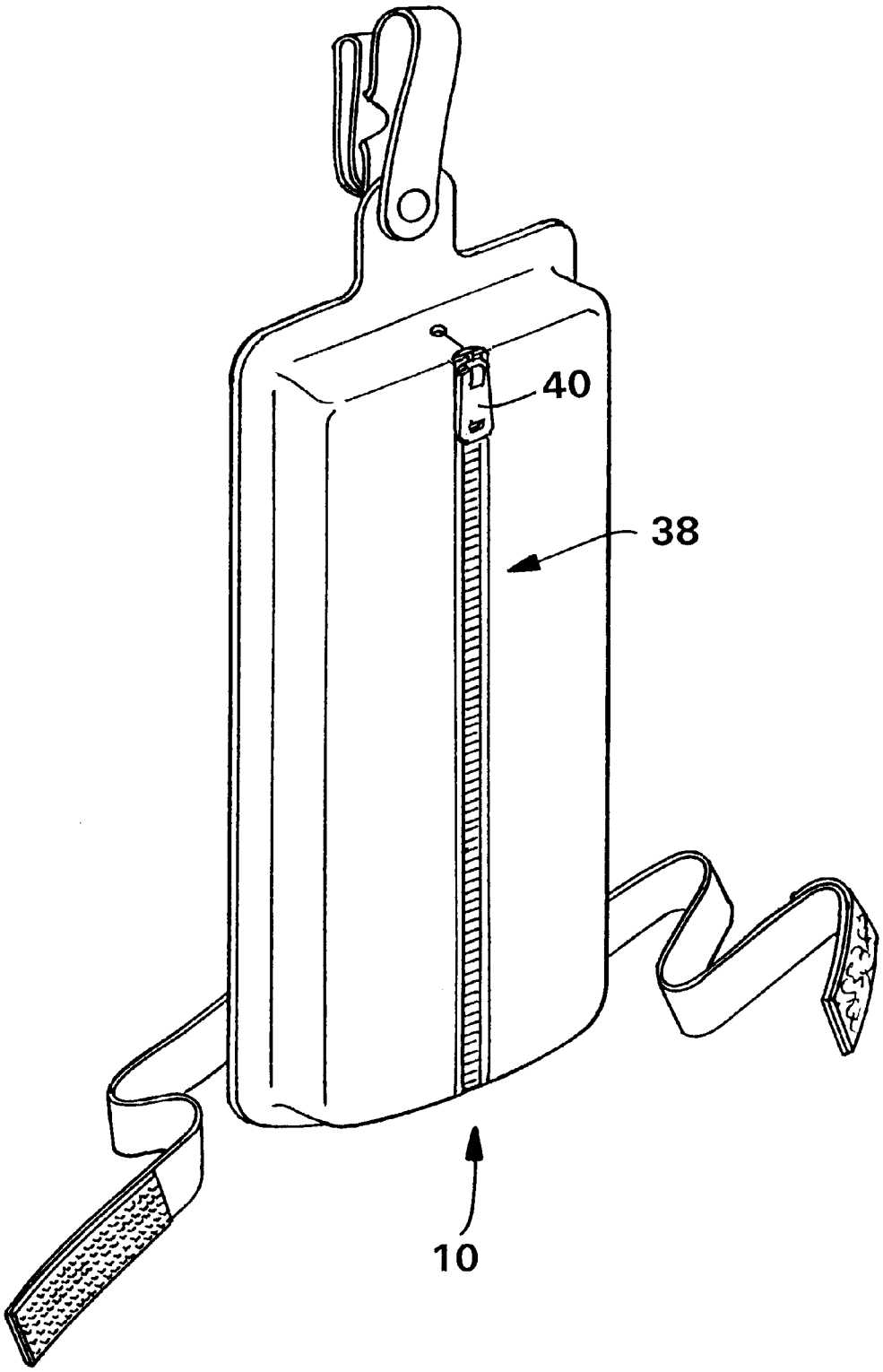
FIG. 7 illustrates a perspective view of an exemplary refillable apparatus for dispensing flexible sheets from a stack of sheets.

FIG. 7 illustrates a perspective view of an exemplary refillable apparatus 10 for dispensing flexible sheets from a stack of sheets. The apparatus 10 is identical to that shown in FIG. 6 except that the dispensing slot 38 is fitted with a zipper 40.

Figure 8:
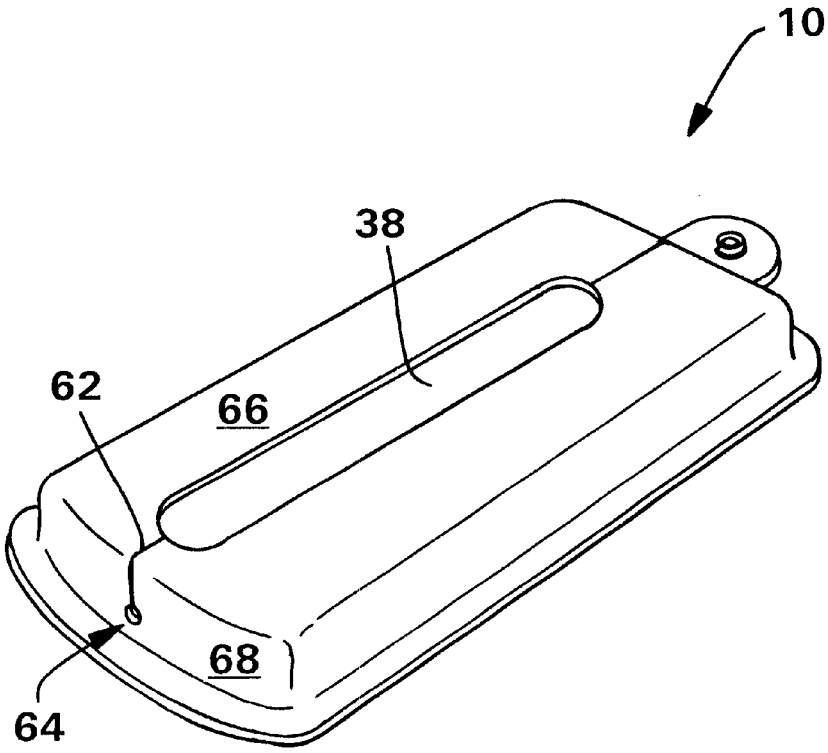
FIG. 8 illustrates a perspective view of an exemplary refillable apparatus for dispensing flexible sheets from a stack of sheets.
Figure 9:
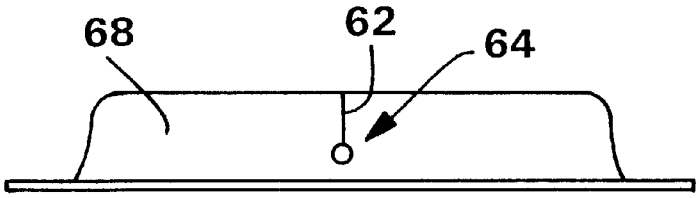
FIG. 9 illustrates a detail of an exemplary refillable apparatus shown in FIG. 8.

FIG. 8 illustrates a perspective view of an exemplary refillable apparatus 10 for dispensing flexible sheets from a stack of sheets. This particular embodiment of the apparatus contains a cut 62 or slice which connect a small hole 64 to the dispensing slot 38. The cut 62 aids the flexure and ease of opening of the cover 34. More specifically, the cut 62 and small hole 64 are particularly useful if the dispensing slot 38 is located only on the face 66 of the cover 34 and not the side portion 68. The small hole 64 serves to dissipate stresses and that may build up at the end of the cut 62. A cut 62 and small hole 64 are located at each end of the dispensing slot. FIG. 9 is an illustration of a side or head-on view of the side portion 68 showing the cut 62 and the small hole 64 shown in FIG. 8.

Figure 10:
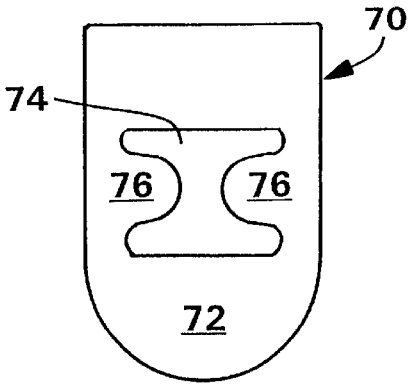
FIG. 10 illustrates a detail of an exemplary refillable apparatus.

FIG. 10 illustrates a detail of a clip 70 from an exemplary refillable apparatus. In particular, FIG. 10 shows the front element 72 of the clip 70. The front element 72 defines an opening 74 with two protrusions 76 which serves as a buckle-like fitting for a band or strap.

Figure 11:
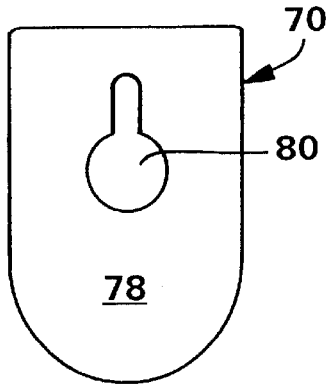
FIG. 11 illustrates a detail of an exemplary refillable apparatus.

FIG. 11 illustrates the rear element 78 of the clip 70. The rear element 78 defines an opening 80 in the shape of a keyhole which can be used to hook the clip onto a protrusions such as, for example, a nail, screw, peg or the like. The rear element 78 is separate but connected to the front element 72. Generally speaking, the clip 70 may be formed from a single piece of rigid material by folding the material over to provide a front element 72 and a rear element 78 that are connected at the fold but separated by a gap.

Figure 12:
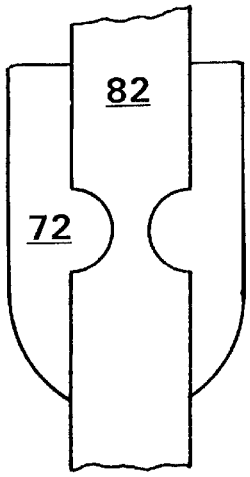
FIG. 12 illustrates a detail of an exemplary refillable apparatus.
Figure 13:
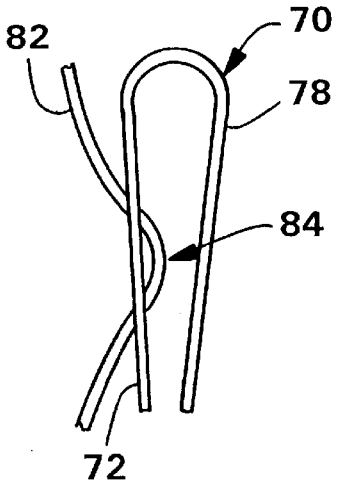
FIG. 13 illustrates a detail of an exemplary refillable apparatus.

FIG. 12 shows the front element 72 serving as a buckle-like fitting for a band 82. The band 82 fits into the opening 74 underneath the two protrusions 76 and back out of the opening 74. FIG. 13 shows a side view of the band 82 as it fits into the front element 72. The portion of the band between the front element 72 and the rear element 78, that is, the interior band portion 84, enhances the effectiveness of the clip 70 by serving as an additional catch for holding onto articles. This is particularly true when the band 82 is formed of a leather-like material or a foamed polymeric material.

Figure 14:
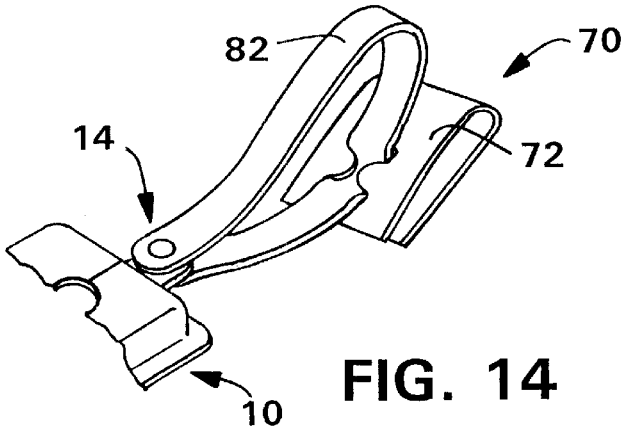
FIG. 14 illustrates a detail of an exemplary refillable apparatus.

FIG. 14 is an illustration of how the clip 70 and the band 82 can be connected to the apparatus 10 by snap fasteners 14. As can be seen, the band 82 passes through the front element 72 of the clip.

The foregoing description relates to several embodiments of the present invention pertaining to a refillable apparatus for dispensing flexible sheets from a stack of sheets, and modifications or alterations may be made without departing from the spirit and scope of the invention as defined in the following claims.

What is claimed is:

1. A portable folded wiper system for dispensing flexible sheets from a stack of sheets, the system comprising a refillable apparatus and a stack of sheets, the refillable apparatus comprising:

a relatively flat, flexible base devoid of dispensing slots, said flexible base being formed of a foamed polymeric material and adapted to resiliently fold along a fold axis, the fold axis of the flexible base being a longitudinal fold axis; and a flexible cover defining an opening aligned in parallel relation to the fold axis of the flexible base, said flexible cover being formed of a foamed polymeric material and attached to said flexible base and adapted to contain a stack of sheets;

said opening defining a dispensing slot through which flexible sheets may be individually dispensed while said flexible base remains unfolded, and said opening defining a refill gap through which a stack of flexible sheets may be inserted when said flexible base is folded back along the fold axis, wherein the flexible base folds back along the longitudinal fold axis upon application of a predetermined folding force and resiliently returns to a relatively flat configuration upon removal of said folding force.

2. The system of claim 1, wherein the stack of sheets are in the form of a pack of sheets within a plastic wrap provided with an aperture along a major face of the pack which conforms to the dispensing slot of the apparatus.

3. The system of claim 1, wherein the foamed polymeric material is foamed poly(ethylene-vinyl acetate) having a density ranging from about 160 $kg/m^3$ to about 240 $kg/m^3$.

4. The system of claim 3, wherein the flexible base is composed of foamed poly(ethylene-vinyl acetate) having a density ranging from about 200 $kg/m^3$.

5. The system of claim 1, wherein the flexible base includes attachment means.

6. The system of claim 5, wherein the attachment means is selected from belt slots, snap fasteners, hook and loop fasteners, clips, clasps, straps, ties, and hooks.

7. The system of claim 1, wherein the cover is composed of two discrete elements arranged to define an opening aligned in parallel relation to the fold axis of the flexible base.

8. The system of claim 1, wherein the cover is composed of a single piece of material having an aperture which defines an opening aligned in parallel relation to the fold axis of the flexible base.

9. The system of claim 1, wherein the opening in the flexible cover is fitted with a closure means selected from zippers, clasps, clamps, snap fasteners, hook and loop fasteners, straps, ties, and hooks.

10. A portable folded wiper system for dispensing flexible sheets from a stack of sheets, the system comprising a refillable apparatus and a stack of sheets, the refillable apparatus comprising:

a relatively flat, flexible base devoid of dispensing slots, said flexible base being formed of a foamed polymeric material and adapted to resiliently fold along a fold axis, the fold axis of the flexible base being a longitudinal fold axis; and a flexible cover defining an opening aligned in parallel relation to the fold axis of the flexible base, said flexible cover being formed of a single piece of foamed polymeric material which is attached to said flexible base and adapted to contain a stack of sheets;

said opening defining a dispensing slot through which flexible sheets may be individually dispensed while said flexible base remains unfolded, and said opening defining a refill gap through which a stack of flexible sheets may be inserted when said flexible base is folded back along the fold axis, wherein the flexible base requires from about 2 to about 5 pounds force to fold it back along its longitudinal axis so that the opening in the cover defines a refill gap through which a stack of flexible sheets may be inserted.

11. The system of claim 10, wherein the stack of sheets are in the form of a pack of sheets within a plastic wrap provided with an aperture along a major face of the pack which conforms to the dispensing slot of the apparatus.

12. The system of claim 10, wherein the foamed polymeric material is composed of foamed poly(ethylene-vinyl acetate) having a density ranging from about 160 kg/m$^3$ to about 240 kg/$^3$.

13. The system of claim 12, wherein the foamed polymeric material is composed of foamed poly(ethylene-vinyl acetate) having a density ranging from about 200 kg/m$^3$.

14. The system of claim 10, wherein the flexible base includes attachment means.

15. The system of claim 10, wherein the opening in the flexible cover is fitted with a closure means.

16. A portable folded wiper system for dispensing flexible sheets from a stack of sheets, the system comprising a refillable apparatus and a stack of sheets, the refillable apparatus comprising:

a relatively flat, flexible base devoid of dispensing slots, said flexible base being formed of a foamed poly (ethylene-vinyl acetate) material having a density ranging from about 160 kg/m$^3$ to about 240 kg/m$^3$ and adapted to resiliently fold along a longitudinal fold axis; and a flexible cover defining an opening aligned in parallel relation to the longitudinal fold axis of the flexible base, said flexible cover being formed of a single piece of foamed poly(ethylene-vinyl acetate) having a density ranging from about 160 kg/m$^3$ to about 240 kg/m$^3$ which is attached to said flexible base and adapted to contain a stack of sheets;

said opening defining a dispensing slot through which flexible sheets may be individually dispensed while said flexible base remains unfolded, and said opening defining a refill gap through which a stack of flexible sheets may be inserted when said flexible base is folded back along the longitudinal fold axis, wherein the flexible base requires from about 2 to about 5 pounds force to fold it back along its longitudinal axis so that the opening in the cover defines a refill gap through which a stack of flexible sheets may be inserted.

17. The system of claim 16, wherein the stack of sheets are in the form of a pack of sheets within a plastic wrap provided with an aperture along a major face of the pack which conforms to the dispensing slot of the apparatus.

18. The system of claim 16, wherein the foamed poly (ethylene-vinyl acetate) has a density of about 200 kg/m$^3$.

19. The system of claim 16, wherein the flexible base includes attachment means.

20. The system of claim 16, wherein the opening in the flexible cover is fitted with a closure means.

21. The apparatus of claim 1, wherein the flexible base requires from about 2 to about 5 pounds force to fold it back along its longitudinal axis so that the opening in the cover defines a refill gap through which a stack of flexible sheets may be inserted.

22. The system of claim 16, wherein the flexible base requires from about 3 to about 4 pounds force to fold it back along its longitudinal axis so that the opening in the cover defines a refill gap through which a stack of flexible sheets may be inserted.

* * * * *